United States Patent [19]

Rousseau

[11] Patent Number: 4,599,811

[45] Date of Patent: Jul. 15, 1986

[54] EASY TO PUT ON WRAP-AROUND SHOE WHICH IS ADAPTABLE TO THE SHAPE OF THE FOOT

[75] Inventor: Jean L. Rousseau, Croix, France

[73] Assignee: Boussac Saint-Freres B.S.F., Lille, France

[21] Appl. No.: 599,709

[22] Filed: Apr. 12, 1984

[51] Int. Cl.[4] ..... A43B 21/00

[52] U.S. Cl. ..... 36/105; 36/8.4; 36/97

[58] Field of Search ..... 36/105, 2.5, 8.4, 97, 36/54, 112; 2/DIG. 6

[56] References Cited

U.S. PATENT DOCUMENTS

| | | | |
|---|---|---|---|
| 2,973,589 | 3/1961 | Rigsby | 36/2.5 |
| 3,142,911 | 8/1964 | Waters | 36/112 |
| 3,618,235 | 11/1971 | Cary, Jr. | 36/97 |
| 4,136,468 | 1/1979 | Munschy | 36/97 |
| 4,178,703 | 12/1979 | Pols | 36/105 |
| 4,377,913 | 3/1983 | Stone | 36/54 |

FOREIGN PATENT DOCUMENTS

| | | | |
|---|---|---|---|
| 2461701 | 11/1976 | Fed. Rep. of Germany | 36/105 |
| 2258138 | 8/1975 | France | 36/112 |
| 2295709 | 7/1976 | France | 36/105 |
| 428127 | 7/1934 | United Kingdom | 36/7.5 |
| 467247 | 9/1935 | United Kingdom . | |
| 673594 | 6/1952 | United Kingdom | 36/112 |
| 1018534 | 1/1966 | United Kingdom | 7/22 |
| 1102640 | 2/1968 | United Kingdom | 3/16 |
| 1156907 | 7/1969 | United Kingdom | 3/16 |

OTHER PUBLICATIONS

Gershman "American Medical Association", vol. 168, No. 7, *Self-Adhering Nylon Tapes,* p. 98, 10/19/1958.

*Primary Examiner*—Henry S. Jaudon
*Assistant Examiner*—Mary A. Ellis
*Attorney, Agent, or Firm*—Owen, Wickersham & Erickson

[57] ABSTRACT

Shoe having an upper part made of supple material and which consists of two side pieces (3,4) attached to the two side edges of the sole (1), and a tongue (5) attached to the front edge of the sole, quick fastening means (7,8,9,10,12,13) being provided to join the tongue (5) to the two side pieces (3,4) at the front and to join the two side pieces (3,4) together at the back in a detachable and adjustable manner.

8 Claims, 3 Drawing Figures

EASY TO PUT ON WRAP-AROUND SHOE WHICH IS ADAPTABLE TO THE SHAPE OF THE FOOT

The present invention relates to a wrap-around type shoe, designed to be easy to put on and capable of fitting the shape of the foot.

Providing suitable shoes for people with deformed feet poses serious problems which, apart from the very expensive manufacture of made-to-measure shoes, have not until now been satisfactorily solved. These problems are particularly serious in a hospital environment, especially as far as concerns elderly people with varying degrees of handicap. In most old people's homes it it usual for the old people to be given slippers to wear. These slippers not only provide no support for the feet, which would, however, be necessary to allow the old people to move about more easily and with less risk, but for the most part they even aggravate these people's handicaps in so far as people generally flatten down the backs of slippers when putting them on, which often eventually causes sores on the heels.

The object of the present invention is a shoe which at the same time provides a good support for the foot, is able to be mould to the shape of the foot and is easy to put on. The object of the invention is also a shoe which is simple and inexpensive to manufacture and easy to keep clean, suitable more particularly for elderly handicapped and/or incontinent people, especially in a hospital environment.

The shoe according to the invention comprises an upper part made entirely of supple material, which comprises two side upper pieces attached to the two side edges of a sole, and a tongue attached to the front edge of the sole, so that the three pieces can be completely opened out to the sides and to the front to make the sole completely accessible from above. The two side pieces of the upper part and the tongue have quick fastening means for joining in a detachable and adjustable way the tongue to the two side upper pieces at the front of the foot and the two side upper pieces together at the back of the foot, so that the upper part completely encases the foot and ensures it is held in position no matter what its shape.

This shoe, which can be completely opened out, is very easy to put on, even for people with deformed feet, since it is necessary merely to place the foot on top of the completely uncovered sole. Pulling the two side pieces of the upper part and the tongue made of supple material up around the foot and fastening these pieces by adjustable fastening means ensures a perfect fit on the foot no matter what its shape.

To enable the shoe to be completely closed at the back of the foot, it is advantageous for one of the two side pieces of the upper part to be lengthened at the back to cover the back edge of the other side piece of the upper part when the shoe is in its fastened position.

To enable the shoe to be completely closed at the front of the foot, it is advantageous for the tongue to cover the front edges of the two side pieces of the upper part when the shoe is in its fastened position.

To improve still more the shoe's action of holding the foot in position, it is advantageous for one of the two side pieces of the upper part to have a tightening strap to be passed over the instep, the free end of this strap being detachably and adjustably joined by a quick fastening means to the other side piece of the upper part.

The quick fastening means for joining the tongue to the two side pieces of the upper part and for joining these two pieces together, and also, possibly, for joining the strap to one of the side pieces of the upper part may be a system of hooks, loops or any other suitable system. However, according to a particularly advantageous embodiment, these fastening means comprise instant interlocking fastening strips such as are sold under the trade mark "VELCRO". This comprises two complementary strips, one having a multitude of projecting hooks and the other a multitude of projecting loops, and the hooks grip the loops when pressure is applied.

It is advantageous for the two side pieces of the upper part and the tongue to be made of a fabric such as canvas, as this facilitates the cleaning of the shoe.

With reference to the attached drawing, an illustrative, non-limiting embodiment of a shoe according to the invention will be described in more detail in the following:

Figure 1:
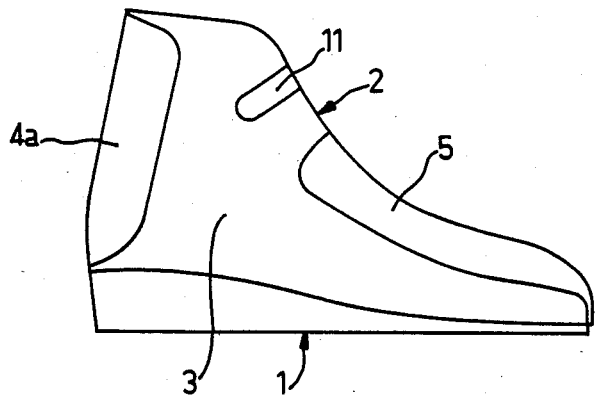
FIG. 1 is a side elevation of a shoe according to the invention in its closed position.
Figure 2:
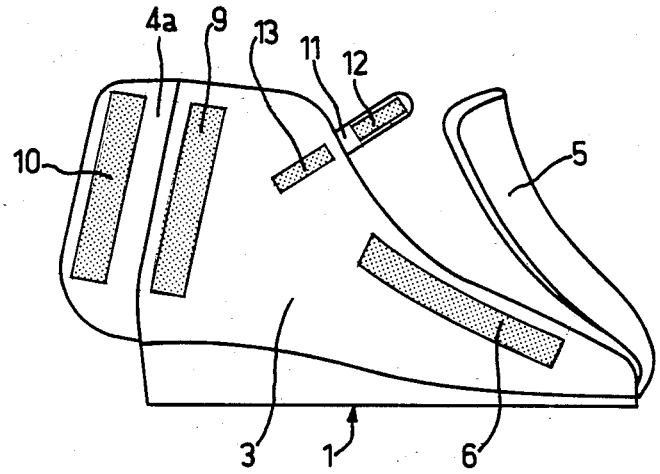
FIG. 2 is a side elevation of the shoe of FIG. 1 in its closed position, the side pieces of the upper part and the tongue being drawn up in relation to the sole.

The shoe according to the invention, as illustrated by the drawing comprises a sole 1 and an upper part 2. The upper part 2 is composed of two side upper pieces 3 and 4 attached to the two side edges of the sole 1 and of a tongue 5 attached to the front edge of the sole 1. The side upper piece 4 is lengthened at the back in comparison with the side upper piece 3, but this lengthened portion, which has the reference numeral 4*a*, is not attached to the back edge of the sole 1.

Figure 3:
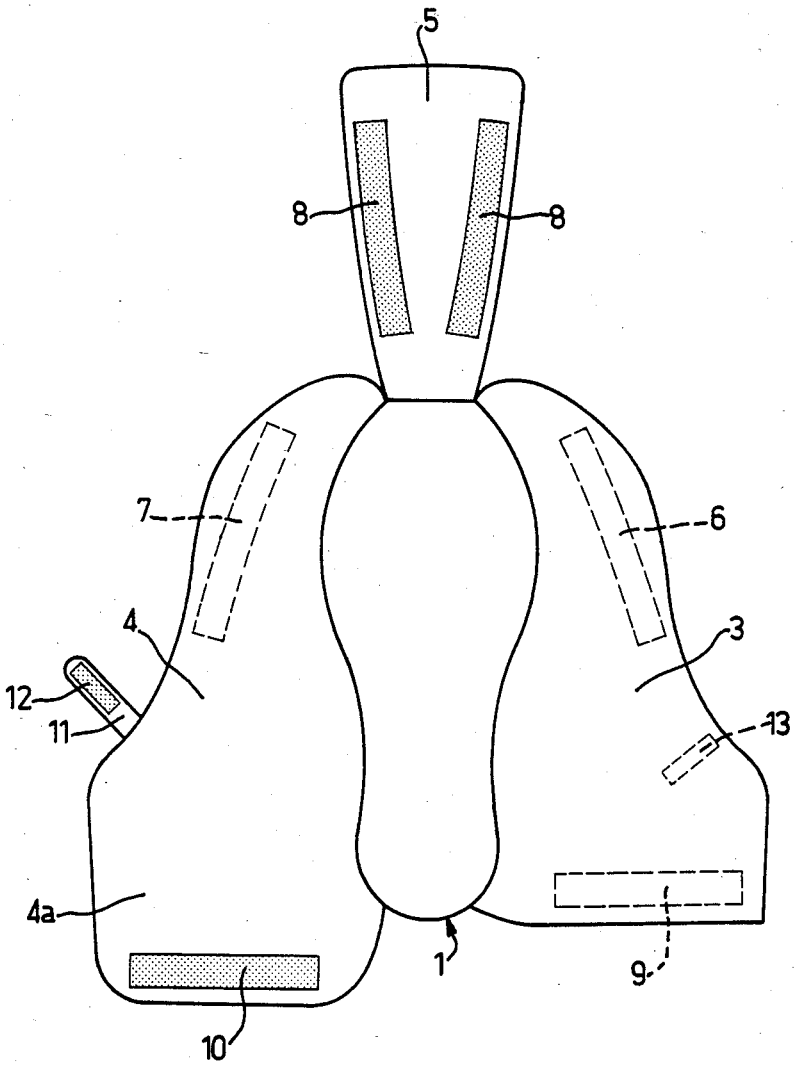
FIG. 3 is a plan view of the shoe according to FIGS. 1 and 2, the side pieces of the upper part and the tongue being folded down in relation to the sole.

Thw two side upper pieces 3,4 and the tongue 5 are made of a supple material, for example a textile such as canvas, and are attached to the sole 1 so that they may be folded down in relation to the sole 1 so as to uncover the top of the sole 1 completely, as shown in FIG. 3. The two side upper pieces 3 and 4 each have near their front edges an instant interlocking fastening strip 6,7 on the under side when the pieces 3 and 4 are opened out according to FIG. 3. Along each of its two side edges on the upper side in the position according to FIG. 3, the tongue has a complementary strip 8 for instant interlocking fastening. The strips 6,7 and complementary strips 8 are of the type marketed, for example, under the trade mark "VELCRO".

A strip 9 for instant interlocking fastening is fixed along the back edge of the side upper piece 3 on the side which in FIG. 3 is facing downwards and a complementary interlocking fastening strip 10 is fixed on the lengthened portion 4*a* of the side upper piece 4 along the back edge of the piece 4*a* on the side which in FIG. 3 is the upper side.

Also, a strap 11 is fixed on the front edge of the upper side piece 4 behind the interlocking fastening strip 7. At its end projecting towards the front on the piece 4 this strap has an interlocking fastening strip 12. A complementary interlocking fastening strip 13 is provided on the other side upper piece 3.

A shoe of this type is put on in the way described in the following.

The wearer places his foot on the sole 1, the upper surface of which is completely uncovered as the two side upper pieces 3,4 and the tongue 5 are opened out in the way shown in FIG. 3. The two side upper pieces 3, 4 are pulled up around the foot and then the tongue 5 is pulled up on the front of the foot. The side edges of the tongue 5 thus cover the front edges of the side upper pieces 3,4 and the fastening strips 8 on the tongue 5 come into position on the fastening strips 6,7 of the pieces 3 and 4. A light pressure on the two side edges of the tongue 5 is all that is needed to interlock the strips 8 on the tongue 5 and strips 6,7 on the pieces 3 and 4.

The back of the side upper piece 3 is then placed around the foot from one side and the back of the side upper piece 4 around the back of the foot from the other side and the lengthened portion 4*a* of piece 4 is placed around the back of the foot on the back edge of the piece 3 so that the fastening strip 10 covers the fastening strip 9. Pressure is exerted on the lengthened portion 4*a* in the region of the strip 10 in order to stick this to strip 9 and thus close the back of the shoe.

The strap 11 on piece 3 is then brought over the instep and its fastening strip 12 is fixed to the complementary fastening strip 13 of piece 3 to help hold the foot in position and close the shoe.

The width of fastening strips 6,7,8,9 and 10 and the length of fastening strips 12 and 13 must be selected so as to allow the shoe to be closed around feet of different shapes and, in particular, deformed feet.

The sole 1 may be made of any suitable material, for example of rope when the tongue 5 and side upper pieces 3, 4 are made of canvas and this rope sole, similar to an espadrille sole, may or may not be plastic-coated. However, it may be advantageous, particularly for people with very deformed feet, for the sole 1 to be made of a thermo-formable material, known per se, which allows there to be better moulding to the shape of the foot.

The side upper pieces 3, 4 and the tongue 5, which may also be made of supple materials other than textile materials, may be fastened to the sole 1 by any suitable method (sewing, gluing, soldering, etc.), depending on the nature of the constituent parts of the shoe.

I claim:

1. A shoe comprising:

a foot supporting, stiff sole having two opposite side edges, a front edge, a rear edge, a bottom face, and a top face, an upper comprising two separate side parts, each made of a continuous sheet of freely flexible supple material, each side part being continuously secured to one of said side edges only and free from the front and rear edges of the sole, and thereby spaced apart at front and rear so that the two upper side parts can be completely folded downwardly and outwardly about the opposite side edges of the sole in order to uncover completely the top face of the sole, so that a foot can be put onto the sole of the shoe while the shoe is completely open, the rear portion of least one said side part being long enough to overlap the other said side part when they are folded up about the foot, a pair of adjustable instant hook-and-loop type fastening means, one located at the rear of each said upper side part and positioned so that the pair can mate, so that when the side parts are folded upwardly against a foot that has been put on the sole and adjusted according to the shape of the foot, the two upper side parts can then be overlapped at the rear and joined together by said fastening means at the rear of the foot, encasing the foot and fitting the foot, thereby supporting any specific foot shape, and further comprising a third upper part forming a front tongue secured to the front edge of the sole only, so that it can be completely folded downwardly about the front edge of the sole, said front tongue having side edges that, when folded upwardly, cover the front edges of the said two upper side parts and said additional fastening means being located on the bottom surface of said front tongue near its side edges and near front of the outer surface of said two upper side parts.

2. A shoe according to claim 1, wherein said rear portion of one of the two upper side parts comprises a rearward projection which covers the rear edge of the other upper side part when the shoe is closed about a foot, one of said fastening means being located on said projection of said one upper side part and another along the rear edge of said other upper side part.

3. A shoe according to claim 1 wherein one of said two upper side parts is provided with a strap member which, when the said two side parts are folded upwardly against the foot, can be passed over the instep, with its free end overlying the other of said two upper side parts, said additional fastening means being located on said strap and on said other upper side part.

4. A shoe comprising:

a foot-supporting, stiff sole having two opposite side edges, a front edge, and a rear edge, a bottom face, and a top face, an upper comprising two separate side parts, each made of a continuous sheet of freely flexible supple material, each side part being continuously secured to one of said side edges only and free from the front and rear edges of the sole, and thereby spaced apart at front and rear, so that the two upper side parts can be completely folded downwardly and outwardly about the opposite sides edges of the sole in order to uncover completely the top face of the sole, so that a foot can be put onto the sole of the shoe while the sole is completely uncovered, one of the two upper side parts having a rearward projection which covers the rear edge and overlaps a marginal portion of the other upper side part when the shoe is closed about the foot, a mating pair of adjustable instant hook-and-loop type fastening means, one located on said projection and the other on the rear marginal portion of said other upper side part, so that when said side parts are folded upwardly against the foot put on the sole, and adjusted according to the shape of the foot, the two upper side parts can be joined together, at the rear of the foot, completely encasing the foot and supporting the foot regardless of its specific shape, and further comprising a third upper part forming a front tongue secured only to the front edge of the sole, so that it can be completely folded downwardly about the front edge of the sole, said front tongue, when folded upwardly, covering the front edges of the said two upper side parts, and additional hook-and-loop type mating fastening means located at each side of said front tongue and along said front edges of said front edges of said two upper side parts.

5. A shoe according to claim 4 wherein one of said two upper side parts is provided with a strap which, when the said two side parts are folded upwardly against the foot can be passed over the instep, with its free end overlying the other of said two upper side parts, and additional hook-and-loop type fastening means located on said strap and on said other upper side part.

6. A shoe comprising:

a foot-supporting, stiff sole having two opposite side edges, a front edge and a rear edge;

an upper comprising two separate side parts and a separate front tongue, each made of a continuous sheet of freely flexible similar supple material, each side part being continuously secured to one of the side edges only and free from the front and rear edges of the sole and thereby spaced apart at front and rear, said tongue having side edges and a front edge and continuously secured only at said front edge to said front edge of said sole, so that the two upper side parts and the tongue can be completely folded downwardly and outwardly about the opposite sides edges and the front edge of the sole in order to uncover completely the top face of the sole, so that a foot can be put on the sole of the shoe while the sole is completely uncovered, and adjustable instant hook and loop-type fastening means, one being located at the front and one at the rear of each said upper side part and one near each side edge of the tongue, so that the side parts can be folded upwardly against a foot put on an uncovered sole and adjusted according to the shape of the foot, and the two upper side parts joined together at the rear of the foot, and the tongue folded upwardly and its fastener means joined to the front fastening means on said side parts, completely encasing the foot.

7. A shoe according to claim 6 wherein one of the two upper side parts has a rearward projection which covers the rear edge of the other upper side part when the shoe is closed about a foot, one of said rear fastening means being located on said projection of said one upper side part and the other located at the rear edge of said other upper side part.

8. A shoe according to claim 7 wherein one of said two upper side parts is provided with a strap which, when the said two side parts are folded upwardly against the foot, passes over the instep, with its free end overlying the other of said two upper side parts, and a further hook-and-loop fastening means located on said strap and mating with another hook-and-loop fastening means on said other upper side part.

* * * * *